United States Patent [19]

Stafford et al.

[11] 4,447,728

[45] May 8, 1984

[54] IONIZER INCLUDING DISCHARGE ION SOURCE AND METHOD

[75] Inventors: George C. Stafford; Donald C. Bradford, both of San Jose, Calif.

[73] Assignee: Finnigan Corporation, Sunnyvale, Calif.

[21] Appl. No.: 346,288

[22] Filed: Feb. 5, 1982

[51] Int. Cl.[3] ..... H01J 27/02

[52] U.S. Cl. ..... 250/423 R; 250/288; 313/362.1

[58] Field of Search ..... 250/423 R, 424, 288; 313/362; 315/111.8

[56] References Cited

U.S. PATENT DOCUMENTS 3,136,908 6/1964 Weinman ..... 250/423

3,886,365 5/1975 Kruger et al. ..... 250/423

*Primary Examiner*—Alfred E. Smith

*Assistant Examiner*—Jack I. Berman

*Attorney, Agent, or Firm*—Flehr, Hohbach, Test, Albritton & Herbert

[57] ABSTRACT

An ionizer for ionizing a sample by bombardment with energetic particles. The ionizer incudes an ion chamber and an adjacent gas discharge region formed with an electrode cooperating wih the ion chamber. Said region serving to discharge a gas to form neutral and charged gas particles. The cooperation of the electrode and chamber accelerates the charged particles and causes charged and uncharged particles to flow into the ion chamber to strike and ionize a sample in the ion chamber.

6 Claims, 8 Drawing Figures

IONIZER INCLUDING DISCHARGE ION SOURCE AND METHOD

This invention relates generally to an ionizer including a discharge ion source and method and more particularly to an ionizer including a discharge ion source and method for secondary ion mass spectrometry.

Mass spectrometers require that the sample molecules be in the gas phase and that the molecules be charged. This is accomplished by an ionizer. In co-pending patent application Ser. No. 241,083 filed Mar. 6, 1981, now U.S. Pat. No. 4,388,531, there is described an ionizer having interchangeable ionization chambers. The ionizer permits operation selectively in the electron impact (EI) and chemical ionization (CI) mode of operation. However, EI and CI ionization is not suitable for the analysis of many thermally labile or high molecular weight molecules such as carbohydrates, peptides and nucleotides in the biological field. One of the more successful methods which has been developed for the analysis of such molecules has been secondary ion mass spectrometry. In this technique, the sample is removed from a target surface by striking the surface with atoms or ions. The resultant particles are charged and in the gas phase whereby they can be mass analyzed. In this connection there has been developed the fast atom bombardment (FAB) method. FAB uses a neutral beam, usually argon atoms, to cause the sputtering. The fast atoms are produced in an atom gun. In the first step argon ions with an adjustable energy between 5 and 10 keV are generated in a discharge source. The beam of ions then passes through a collision region filled with neutral argon atoms. By means of collisions between fast ions and "resting" atoms charge exchange occurs. In most cases it occurs without a drastic loss of kinetic energy resulting in a beam of fast argon atoms. These argon atoms hit the target laden with sample and sample ions are generated. The sample ions are focused and travel through the optics of the associated mass spectrometer.

One of the important steps in getting good results is the sample preparation. The sample is usually dissolved or suspended in a solvent. A widely used solvent is glycerol. In some cases with additives like oxalic acid or alkali halogenides. Fortunately glycerol is a good solvent for a lot of biologically important compounds such as the above mentioned peptides, sugars, nucleotides and salt forms of these compounds. A drawback with the prior art analyzers and methods is the requirement for a separate "fast atom gun" and its associated power supplies and controls.

It is an object of the present invention to provide an ionizer which produces energetic particles by electric discharge.

It is a further object of the present invention to provide a discharge source which is extremely close to the sample probe thereby providing high beam intensity of energetic particles which strike the probe.

It is a further object of the present invention to provide an ionizer which produces energetic particles by discharge ionization adjacent the sample probe.

The foregoing and other objects of the invention are achieved by an ionizer including a chamber and an opening into said chamber with a discharge electrode disposed adjacent said opening in cooperative relationship with the chamber to support a gas discharge and form energetic particles which are directed through said opening into said chamber to impinge on a sample in said chamber.

The foregoing and other objects of the invention will be more clearly understood from the following description and accompanying drawings in which FIG. 1 is an elevational view of an ionizer assembly incorporating the present invention;

Figure 1:
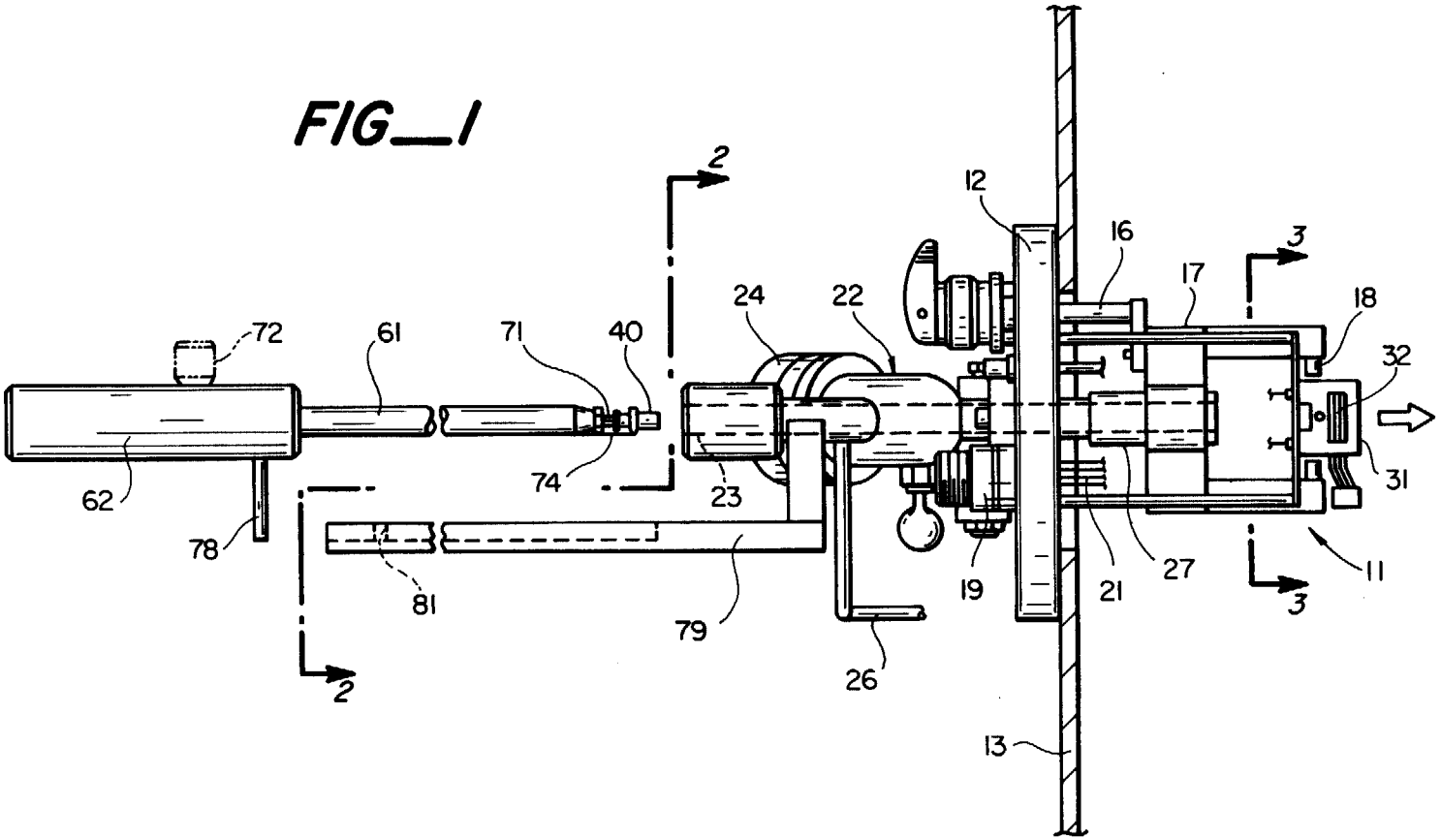
Figure 2:
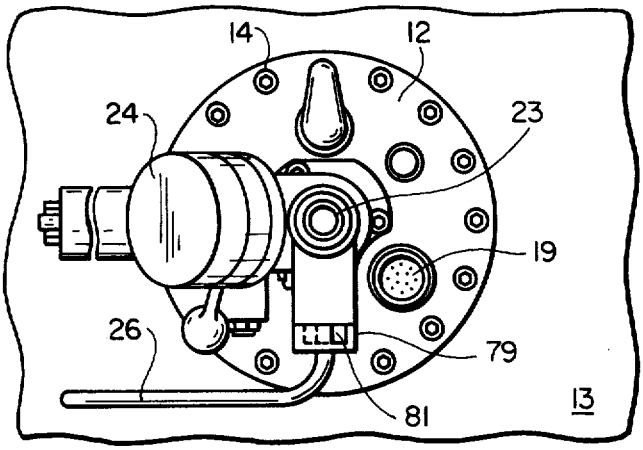
FIG. 2 is a view taken generally along the line 2—2 of FIG. 1.
Figure 3:
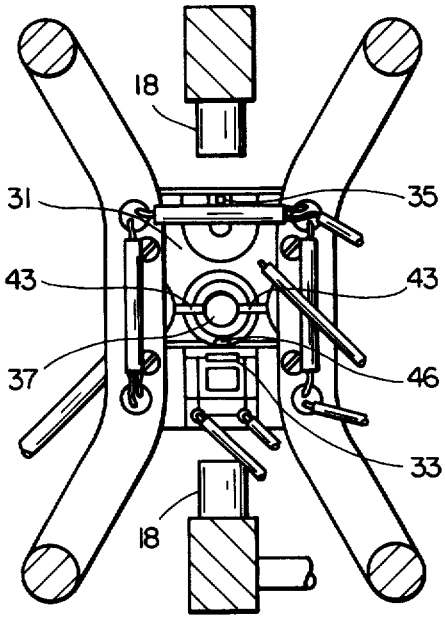
FIG. 3 is a sectional view taken along the line 3—3 of FIG. 1.

An ionizer assembly with which the present invention may be used is shown in FIGS. 1, 2 and 3. This assembly is of the type described and claimed in the above referenced patent application. The assembly includes an ionizing assembly 11 mounted on flange 12. The flange provides for attaching the ionizer to the vacuum envelope 13 of associated equipment such as a mass spectrometer. Screw 14 may be employed to fasten the flange 12 to the envelope 13. A magnet control rod 16 extends through the flange and controls the position of the magnet 17 and magnet poles 18. An electric feed through 19 is connected to the flange and provides a feed through for the leads 21 which apply voltages and currents to the electrodes, collector or gas discharge electrode, etc.

Also shown connected to the flange is a vacuum lock assembly 22. The vacuum lock assembly permits the insertion of a sample probe into the ion volume. In accordance with the present invention the vacuum lock also permits the insertion and removal of ion volumes into the ionizing section 11. Briefly, the valve works in the following manner. A probe is inserted axially into the end 23 where it is engaged tightly by an O-ring which forms a vacuum seal. At this point the volume between the O-ring and the valve 24, which is closed, is evacuated through the tube 26. The valve 24 can now be opened allowing the probe to enter the envelope via the guide tube 27 to the ionizer chamber. If the probe is a sample probe the solid sample is placed in the ionization chamber. As will be described, if an insertion and removal tool is being used it either inserts an ionization volume into the ionizer chamber or engages an ionization volume for removal from the ionizer chamber.

To remove the probe or tool it is withdrawn past the valve 24. The valve 24 is then closed and the tool or probe removed.

The ionizing section 11 comprises a source block 31 (FIGS. 1 and 3) which serves to support an ionization chamber, accelerating and focusing electrodes 32, filament assembly 33 and a collector or gas discharge electrode 35.

Figure 7:
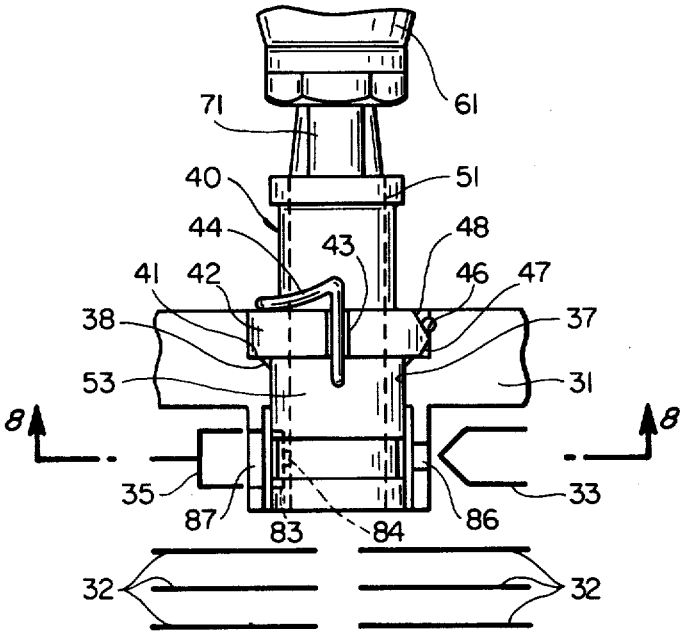
FIG. 7 is an enlarged view showing an ion chamber inserted in an ionizer chamber in cooperative relationship with a discharge electrode and sample probe.

The ionizer assembly 11 includes a mount having a guide hole 37, (FIGS. 3 and 7). The hole 37 includes a conical surface 38 which serves to guide and center an associated interchangeable ion chamber 40 as it is inserted. The hole includes stop shoulder 41 against which rim 42 abuts to position the ion volume 40. Slots 43 accommodate the retaining spring 44 of the ion chamber. A spring 46 is supported by the source block 31 and releasably engages and holds the ion chamber 40. Preferring particularly to FIG. 7 it is seen that the rim 42 includes two camming surfaces 47 and 48. When the ion chamber is inserted in the ionizer the surface 47 moves the spring 46 outward. The spring then rides on the surface 48 where it forces or urges the ion volume into firm seating engagement with the shoulder 41 and holds the ion volume in the ionizer chamber. The slots 43 and spring 44 serve to orient the ion volume so that the openings in the chamber are all aligned with the source block 31. The shoulder fixes the axial position so that the end of the ion volume is properly positioned with respect to the ion focusing lenses 32.

Figure 4:
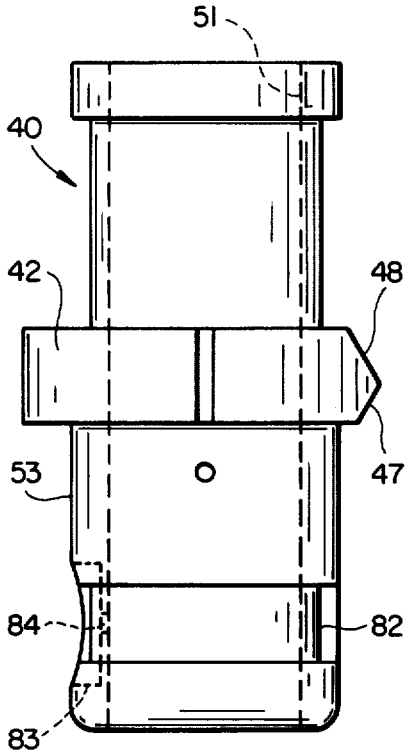
FIG. 4 is an elevational view of an ion chamber suitable for use in the ionizer of the present invention.
Figure 5:
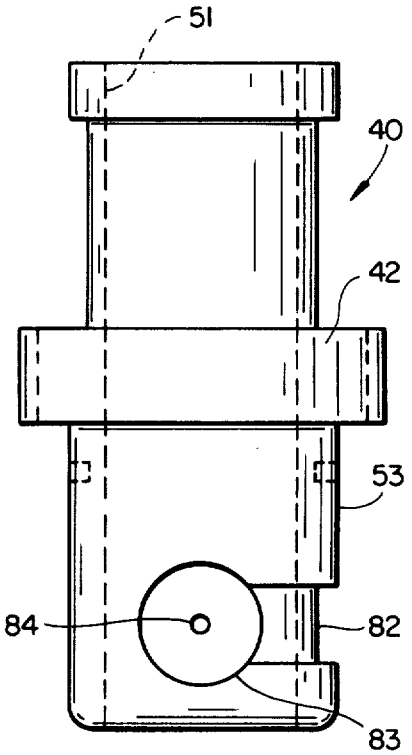
FIG. 5 is an elevational view of the ion chamber shown in FIG. 4 taken from a different direction.
Figure 6:
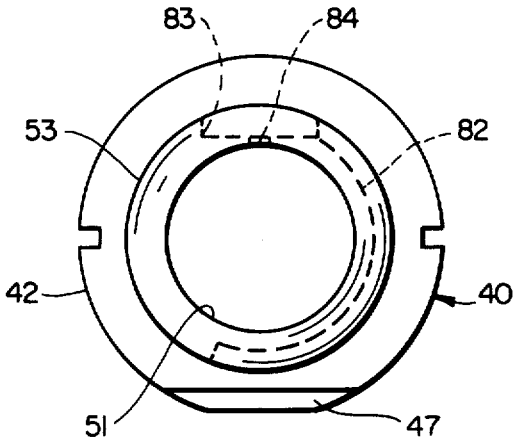
FIG. 6 is a bottom view of the ion chamber shown in FIGS. 4 and 5.

FIGS. 4, 5 and 6 show an ion chamber 40 in accordance with the present invention. The end has an opening 51 through which the sample probe may be inserted into the ion chamber. The ion chamber proper is defined by the cylindrical end 53. An ion chamber insertion and removal tool is shown in FIGS. 1 and 7. The tool includes a hollow barrel 61 having one end secured to a handle 62. A probe extends coaxially in the barrel. Spring fingers are secured to the end of the barrel 61 by suitable means. The end of the probe serves to spread the fingers 71. With the fingers collapsed they can be inserted into the end 51. The probe is then moved to expand the fingers into the ion chamber for insertion or removal of the ion chamber. To assure that the tool is inserted to the proper depth there are provided stop means. The stop means comprise in combination the pin 78, FIG. 1, attached to the tool handle and the grooved guide bar 79. The tool is inserted until the pin strikes the first stop 81. The volume between the probe and vacuum valve 22 is then evacuated. The tool is rotated so that the pin 78 rides along the slot until the rim 42 strikes the stop shoulder 41 for insertion.

An ion chamber suitable for discharge ionizations secondary ion mass spectrometry is shown in detail in FIGS. 4–6. The ion volume includes rim 42 having camming surfaces 47 and 48 and end 51 for receiving the insertion tool. The working ion volume is defined by the hollow cylindrical end 53. In accordance with the present invention the outer surface of the end 53 is provided with a circumferential groove 82 which as will be presently described serves to guide or direct the discharge gas which produces fast ions or neutrals for the secondary ion emission. The groove terminates in a cylindrical well 83. The bottom of the well includes a hole 84 communicating with the interior of the ion volume.

Figure 8:
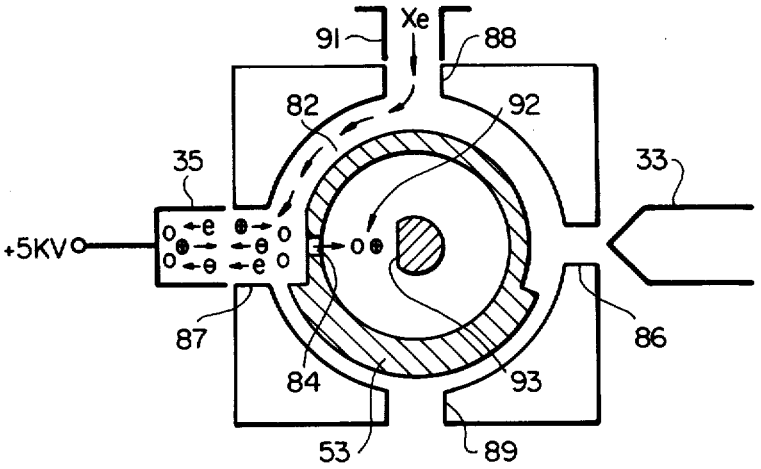
FIG. 8 is a sectional view taken generally along the line 8—8 of FIG. 7.

Referring now more particularly to FIGS. 7 and 8 the ion volume 40 is shown inserted in source block 31. The block is of conventional configuration and therefore includes opening 86 for electrons, from the filament 33 opening 87 for collector or gas discharge electrode 35, opening 88 for the conduction of gas into the chamber and opening 89 for conduction of gas.

In accordance with the present invention, however, the ion chamber is inserted into the source block blocking the holes 88 and 89 and providing communication from a source of gas through nozzle 91 such as xenon, argon or other gas capable of supporting a gas discharge. The groove 82 as shown by the arrows conducts the gas to and through the opening 87 so that the gas flows into the gas discharge electrode 35. In accordance with the present invention the electrode 35 is maintained at a high positive voltage with respect to the source block 31 which may be at the ground potential. The voltage may, for example, be 5,000 volts. This voltage causes a gas discharge within the gas discharge electrode which generates electrons (e), positive ions (+), negative ions (⊖) and neutrals (o). Because of the positive voltage on the collector the negative ions and electrons are collected. The positive ions (+) are repelled and accelerated towards the opening 84 in the ion chamber 40. These fast accelerated positive particles will collide with neutral gas atoms and undergo charge exchange producing fast or energetic neutral gas particles. This beam 92 of fast gas atoms and positive ions travel at high velocity towards the surface 93 of the probe. The surface of the probe is coated with the solvent/sample matrix. The fast gas atoms and positive ions cause secondary solvent/sample ions. The ions are accelerated by the ion focusing lenses 32 into the associated mass spectrometer for analysis.

We claim:

1. An ionizer including a chamber having an opening extending into said chamber, a discharge electrode disposed adjacent said opening in cooperative relationship with said chamber, means for introducing discharge gas to said discharge electrode, means for establishing a discharge voltage between said chamber and said discharge electrode to form a gas discharge which forms charged gas particles, said discharge voltage serving to accelerate the charged particles toward said opening to cause charged and uncharged particles to pass through said opening into said chamber.

2. An ionizer as in claim 1 in which said chamber comprises an ionizer block and an insertable ion chamber, said ion chamber and block cooperating to define a gas passage for directing gas to said electrode.

3. An ionizer as in claim 2 in which sad block includes a gas opening and said insertable ion chamber includes a groove which communicates between said gas opening and said opening to direct gases flowing into said gas opening to said gas discharge electrode.

4. An ionizer including an ionizer block having a central volume defined by an opening and at least first and second spaced holes extending through the walls of said ionizer block, a discharge electrode disposed adjacent one of said holes in cooperative relationship with said ionizer block, an insertable ion volume adapted to be inserted into said ionizer block central volume closely adjacent to the walls of said block, an opening in the ion chamber in alignment with one of said ionizer block openings, a groove formed on the outer surface of said ionizer chamber and communicating between said first and second ionizer block openings to direct gas from one opening to said discharge electrode, means for establishing a voltage between said ionizer block and said electrode to form a discharge which injects energetic particles through said aligned ionizer block and ionizer chamber opening into said ionizer chamber.

5. The method of generating sample ions which comprise the steps of defining an ion chamber, supporting a sample in said chamber on a support surface, providing a discharge voltage region adjacent said chamber, introducing a discharge gas in said discharge voltage region to cause gas discharge and form charged particles, employing said discharge voltage to accelerate said charged gas particles to cause charged and uncharged particles to flow into said ion chamber to impinge upon said support surface to ionize said sample and form sample ions.

6. An ionizer including a chamber having an opening extending into said chamber, a discharge electrode disposed adjacent said opening in cooperative relationship with said chamber, means for supporting a sample in said chamber, means for introducing discharge gas to said discharge electrode, means for establishing a discharge voltage between said chamber and said discharge electrode to form a gas discharge which forms charged gas particles, said discharge voltage serving to accelerate charged particles and cause charged and uncharged particles to travel through said opening into said chamber to impinge upon said sample and form sample ions.

* * * * *